United States Patent [19]

Bratt

[11] Patent Number: 4,499,726

[45] Date of Patent: Feb. 19, 1985

[54] HEATER HEAD FOR A MULTI-CYLINDER HOT GAS ENGINE

[75] Inventor: Christer Bratt, Malmö , Sweden

[73] Assignee: United Stirling AB, Malmö , Sweden

[21] Appl. No.: 558,478

[22] Filed: Dec. 6, 1983

[51] Int. Cl.[3] ..... F02G 1/04

[52] U.S. Cl. ..... 60/517; 60/525

[58] Field of Search ..... 60/517, 525, 526

[56] References Cited

U.S. PATENT DOCUMENTS 2,817,950 12/1957 Van Weenen et al. ..... 60/525

4,261,173 4/1981 Lorant ..... 60/525

*Primary Examiner*—Allen M. Ostrager

*Attorney, Agent, or Firm*—Finnegan, Henderson, Farabow, Garrett & Dunner

[57] ABSTRACT

A heater head of a multi-cylinder hot gas engine having an annular regenerator housing surrounding each cylinder is provided with three manifolds at the top of each cylinder-regenerator housing unit.

Each manifold is arcuately shaped and covers 360/2·n degrees—n being the number of engine cylinders.

One manifold has an outer and inner row of arcuately disposed tube connections to the interior of the cylinder, and is disposed between the two other manifolds.

One of the remaining manifolds has a single row of tube connections to the regenerator said row being a continuation of said inner row whereas the last manifold has a single row of tube connections being a continuation of the said outer row.

3 Claims, 2 Drawing Figures

HEATER HEAD FOR A MULTI-CYLINDER HOT GAS ENGINE

BACKGROUND OF THE INVENTION

1. Field of the Invention

This invention relates to a heater head for a multi-cylinder hot gas engine of the type having regenerator housings of annular cross section surrounding the cylinders of the engine, said heater head comprising arcuately shaped primary manifolds connected to the cylinder tops, arcuately shaped secondary manifolds connected to the regenerator housing tops, and a plurality of equally shaped heater tubes connecting said primary and secondary manifolds which when mounted together form two coaxially disposed circular tube row connections.

2. Description of the Prior Art

The U.S. Pat. No. 4,261,173 shows a hot gas engine heater head of known design in which the primary manifolds together form a complete circular tube row connection and in which the secondary manifolds together form another complete circular tube connection. The manifolds of each cylinder-regenerator housing unit of the known four-cylinder engine extend through a common 90 degree angular section. This involves radial gaps through the heater head between the adjacent manifolds. Such gaps may increase due to thermal deformations and they will involve loss of heat.

In case of uneven heat transfer to the heater head one cylinder-regenerator unit may be exposed to greater heat than the other units. This will result in a lower average heater head temperature because the temperature is governed by the peak value. A lower average hot gas temperature will cause a decrease of the engine efficiency.

SUMMARY OF THE INVENTION

The object of the invention is to provide a hot gas engine heater head of the type referred to above which will improve the efficiency of the heating system as well as of the energy conversion of the engine.

According to the present invention this is obtained by a heater head in which each of the primary manifolds extends arcuately through 360/2·n degrees, where n is the number of engine cylinders, each of the primary manifolds comprises two coaxially disposed segments of tube connections, and each regenerator housing is provided with two secondary manifold segments, each of which being of the same angular size as the primary manifold and extending at each side thereof, one of the secondary segments forming a part of the outer one of the circular tube connections and the other forming a part of the inner one of the circular tube connections.

The invention will be described in more detail below, with reference being made to the accompanying drawings.

BRIEF DESCRIPTION OF THE DRAWING

In FIGS. 1 and 2 the wall of a cylinder in a four-cylinder hot gas engine has been designated by the reference numeral 1. Said wall 1 is surrounded by a regenerator 2 enclosed in a regenerator housing 3, also of cylindrical shape. At the top of the cylinder wall 1 and the regenerator housing 3 three arcuately shaped manifolds 4, 5 and 6 are formed. The manifold 4-a primary manifold-is adapted for connections between heater tubes and the interior of the cylinder limited by the wall 1. The manifolds 5 and 6-secondary manifolds-are adapted for connections between heater tubes and the interior of the regenerator housing 3.

Only one heater tube 7 is shown, for establishing connection between the manifolds 4 and 5. However, in the embodiment shown six tubes of identical shape should be used for this purpose and further six should be used for connection between the manifolds 4 and 6.

Figure 1:
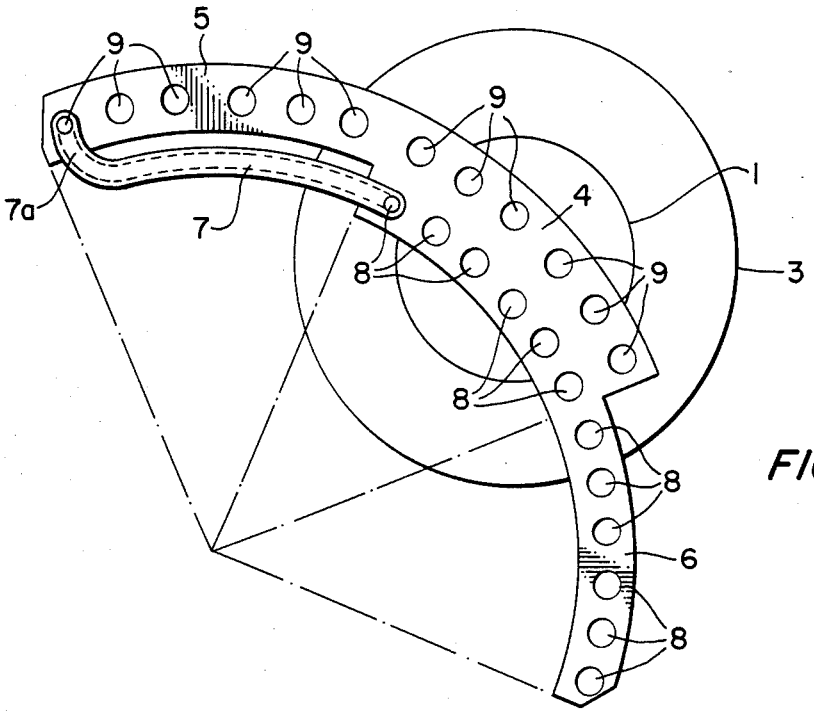
FIG. 1 shows schematically a plan view of a part ($\frac{1}{4}$) of a four-cylinder hot gas engine heater head and FIG. 2 is a vertical section through the part shown in FIG. 1.

The tube 7 starts from the upper left one of a series of twelve circular disposed tube connections 8 located at an inner part circle, as shown in FIG. 1. As shown also with reference to FIG. 2 the tube 7 extends inclined upwardly following an imaginary cylindrical surface. The tube terminates upwardly by a radially outwardly bent part *7a* which is subsequently bent vertically downwardly forming a vertical tube part *7b*. The last mentioned tube part *7b* is connected to the regenerator housing manifold 5.

As will be understood the angular extension of the three manifolds 4, 5 at the leftmost of the twelve circular disposed outer tube connections 9 and 6 should each be 45 degrees i.e. 360/2 n, n being the number of engine cylinders in order to obtain a complete circle of all primary and secondary manifolds of the engine.

All tubes 7 are equally mounted connecting an inner row of circularly disposed tube connections 8 with outer tube connections 9. Due to the inclination of the tubes along their inclined parts along their parts connected to the connections 8 the gaps between adjacent vertical tubes will be smaller than the gaps between adjacent tube parts *7b*. The tube parts *7b* may be provided with surface enlarging fins 10 as shown in FIG. 2 and as is well known in the art.

Figure 2:
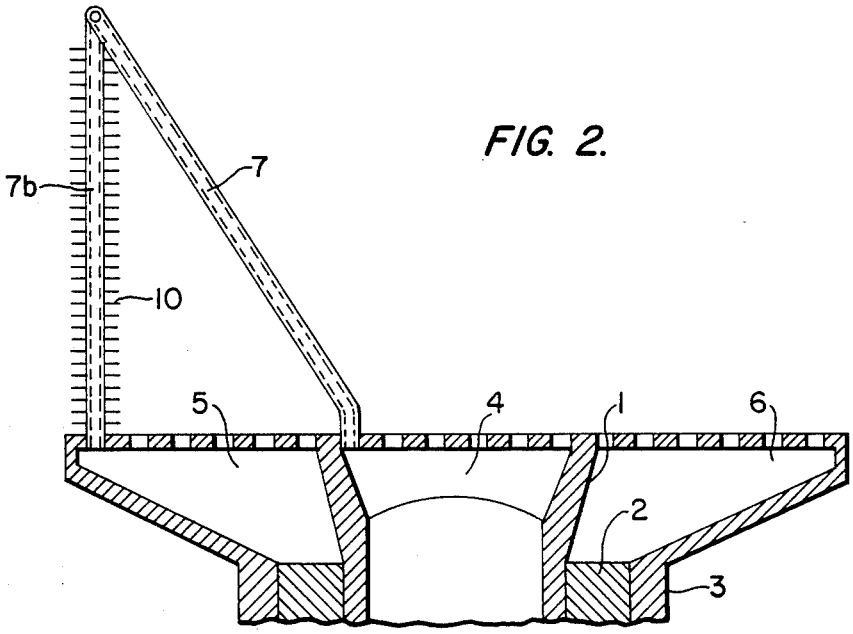

It will also be understood that the manifold 6 of the cylinder-regenerator housing unit shown in FIGS. 1 and 2 will angularly overlap the manifold 5 of an adjacent cylinder-regenerator housing (not shown). Such overlapping will ensure a uniform flow of combustion gases between the heater tubes of the engine.

It is also an advantage that the inclined tube parts which are directly exposed to heat radiation are longer than the tube parts *7b* which are "shadowed". This will increase the efficiency when the engine is running at part load due to the fact that tube parts exposed to radiation will obtain a higher temperature than the "shadowed" parts at part load of the engine. The radiation is caused by a combustion of fuel with air in the central parts of the space surrounded by the tubes 7.

What is claimed is:

1. In a heater for a multi-cylinder hot gas engine of the type having regenerator housings of annular cross section surrounding the cylinders of the engine, said heater head comprising arcuately shaped primary manifolds connected to the cylinder tops, arcuately shaped secondary manifolds connected to the regenerator housing tops, and a plurality of equally shaped heater tubes connecting said primary and secondary manifolds which when mounted together form two coaxially disposed, circular tube connections, the improvement comprising each of said primary manifolds extending arcuately through 360/2·n degrees where n is the number of engine cylinders, each of said primary manifolds including two coaxially disposed segments of tube connections, and each regenerator housing being provided with two secondary manifold segments, each of which being of the same angular size as said primary manifold and extending at each side thereof, one of said secondary segments forming a part of the outer one of said circular tube connections and the other forming a part of the inner one of said circular tube connections.

2. The improvement in a heater head according to claim 1, wherein each heater tube is arranged between the inner and the outer circular tube connection, said heater tube extending angularly through 360/2·n degrees.

3. The improvement in a heater head according to claim 1, wherein each heater tube extends inclined upwardly from the inner circular tube connection following an imaginary cylinder of a diameter corresponding to that of the inner circular tube connection, each heater tube is bent outwardly at its top location, and each heater tube continues vertically downwardly to the outer circular tube connection.

* * * * *